US007057487B2

(12) United States Patent
Rothmayer et al.

(10) Patent No.: US 7,057,487 B2
(45) Date of Patent: Jun. 6, 2006

(54) FORMER AND COIL FOR PRINTED CIRCUIT BOARD ASSEMBLY

(75) Inventors: Thomas Rothmayer, A-Wien (AT); Harald Weinmeier, A-Wien (AT)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/503,274

(22) PCT Filed: Feb. 10, 2003

(86) PCT No.: PCT/AT03/00037

§ 371 (c)(1),
(2), (4) Date: Jul. 29, 2004

(87) PCT Pub. No.: WO03/069640

PCT Pub. Date: Aug. 21, 2003

(65) Prior Publication Data

US 2005/0104707 A1 May 19, 2005

(30) Foreign Application Priority Data

Feb. 12, 2002 (AT) ..... A 218/2002

(51) Int. Cl.
*H01F 27/30* (2006.01)

(52) U.S. Cl. ..... 336/198; 336/192

(58) Field of Classification Search ..... 336/65, 336/90, 192, 198, 200, 223
See application file for complete search history.

(56) References Cited

U.S. PATENT DOCUMENTS

| | | | | |
|---|---|---|---|---|
| 2,941,172 | A | 6/1960 | Sutton, Jr. | |
| 3,169,234 | A | 2/1965 | Renskers | |
| 3,548,356 | A | 12/1970 | Wright | |
| 3,609,616 | A * | 9/1971 | Dumeige | 336/192 |
| 3,649,939 | A * | 3/1972 | Hildebrandt | 336/65 |
| 4,345,231 | A * | 8/1982 | Cline et al. | 336/192 |
| 4,484,170 | A * | 11/1984 | Wirth et al. | 336/65 |
| 6,842,101 | B1 * | 1/2005 | Maguire et al. | 336/198 |

FOREIGN PATENT DOCUMENTS

| | | |
|---|---|---|
| DE | 20 47 901 A | 4/1972 |
| DE | 199 58 199 A1 | 6/2000 |

* cited by examiner

*Primary Examiner*—Tuyen T Nguyen

(57) ABSTRACT

The invention relates to a former and a coil for printed circuit board assembly, consisting of a prismatic or cylindrical coil form for at least one coil and a foot part, which is configured as one piece with the coil form, at least sections of said part protruding externally above the coil form. According to the invention, connecting wires for the coil or coils are formed from the coil wire and their ends are configured as solder terminals, which are housed and held in wire guides of the foot part.

13 Claims, 2 Drawing Sheets

FORMER AND COIL FOR PRINTED CIRCUIT BOARD ASSEMBLY

CROSS REFERENCE TO RELATED APPLICATIONS

This application is the US National Stage of International Application No. PCT/AT03/00037, filed Feb. 10, 2003 and claims the benefit thereof. The International Application claims the benefits of Austrian application No. 218/2002 filed Feb. 12, 2002, both of the applications are incorporated by reference herein in their entirety.

FIELD OF INVENTION

The invention relates to a coil former and a coil for circuit board mounting, comprising a prismatic or cylindrical winding form for at least one coil, and a base forming a single piece with said winding form and projecting out over said winding form at least in sections.

BACKGROUND OF INVENTION

In wound components, by which is essentially meant inductive components in the power supply area, the coils on a winding form are generally connected to pins by routing the wire ends of one or more coils to corresponding solder pins, wrapping them around same and then soldering them. In another known solution, the coil consists of a broad and relatively rigid metal tape which can be soldered directly to a conductor track of a printed circuit board.

With the known solutions, either the labor input involved in fabricating the wound component as a whole is high, e.g. if the leads of the coil are to be soldered to solder pins, or difficulties arise with soldering to PCB conductor tracks, as is the case, for example, with the design using a wound metal tape.

SUMMARY OF INVENTION

The object of the invention is to simplify the design of the wound component for ease of mounting on a printed circuit board, thereby reducing costs.

This object is achieved according to the invention by forming leads for the one or more coils from the latters' winding wire and implementing them with their ends as solder pins which are accommodated in wire guides of the base and retained therein.

Thanks to the invention, one operation, namely the soldering of the coil to separate solder pins, can be dispensed with during fabrication of the coil former with the coil, and therefore of the wound component. As the ends of the winding wire are accommodated in the wire guides of the base and retained therein, there is produced a defined spacing of the solder pins corresponding to the drilled holes provided on the printed circuit board.

In a useful variant, wire guides are implemented in opposite sections of the base relative to the coil axis, resulting in increased stability of the wound component disposed on the printed circuit board.

In another useful variant it is provided that the wire guides are implemented as drilled holes in the base through which one end of the coil wire can be inserted, thereby providing a simple means of immovably fixing the solder pins.

On the other hand it may also be expedient for the wire guides to be implemented as outwardly open grooves in the base into which one end of the coil wire can be inserted from the outside. This variant is useful if the wire is relatively stiff because of its diameter or material characteristics, so that threading it through drilled holes after winding could prove difficult, it being advantageous in view of the desired secureness of the solder pins if the grooves are narrowed towards the outside, the coil wire snapping into place.

In a particularly practical variant it is provided that in one section of the base at least one wire guide is implemented as a drilled hole and in an oppositely located section at least one wire guide is implemented as an open groove. This embodiment provides on the one hand high stability and accuracy of fit of the solder pins and, on the other, allows ease of fabrication even with relatively stiff winding wire.

In usual and useful embodiments of the invention, the coil wire has a diameter of 1 to 4 mm and the coil wire is advantageously implemented as copper wire.

BRIEF DESCRIPTION OF THE DRAWINGS

The invention together with further advantages will now be explained in greater detail with reference to embodiments illustrated in the accompanying drawings in which.

DETAILED DESCRIPTION OF INVENTION

Figure 1:
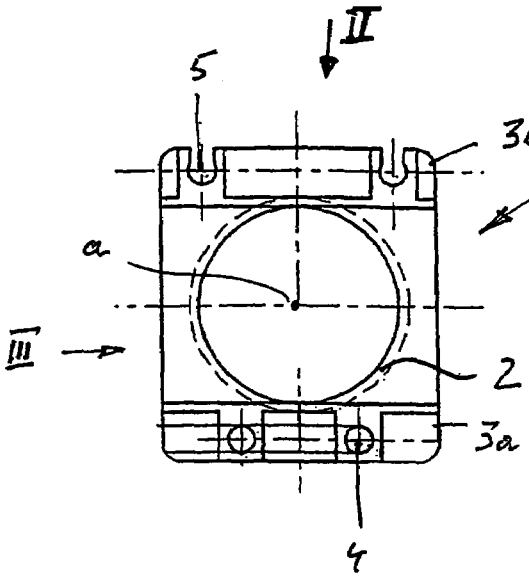
FIG. 1 shows a plan view of a first embodiment of the invention.
Figure 2:
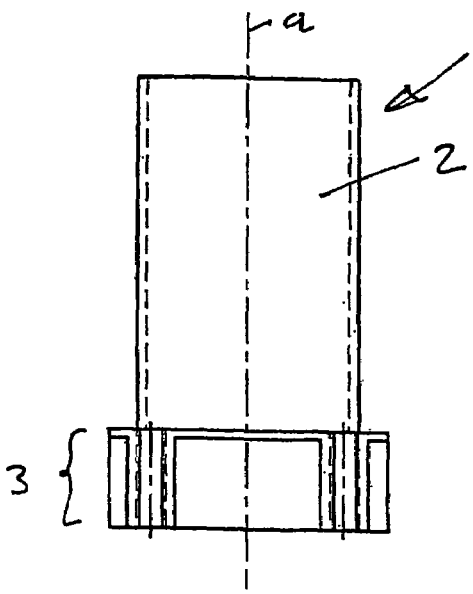
FIG. 2 shows a side view in the direction of the arrow II of FIG. 1.

As may be seen from FIGS. 1 and 2, a coil former 1 consists of a cylindrical winding form 2 and a base 3 forming a single piece with same. The entire coil former 1 is made of a plastic material such as polyamide, produced e.g. by injection molding. Of course, any materials suitable for the relevant application in terms of their electrical, thermal and mechanical properties can be used for the coil former 1.

In this case the base 3 is rectangular and projects—not visible in plan view—out over the winding form 2 all round. Of importance for the invention are two sections 3*a*, 3*b* which are opposite relative to the coil axis 1 and in which wire section 3*b* and two outwardly open grooves 5 in the other section 3*a*. As may be best seen from FIG. 1, the grooves 5 are narrowed towards the exterior, so that there is provided a snap fit for a wire of suitable diameter pressed into the grooves from outside. The drilled holes 4 and the grooves 5 run parallel with the coil axis a.

Figure 3:
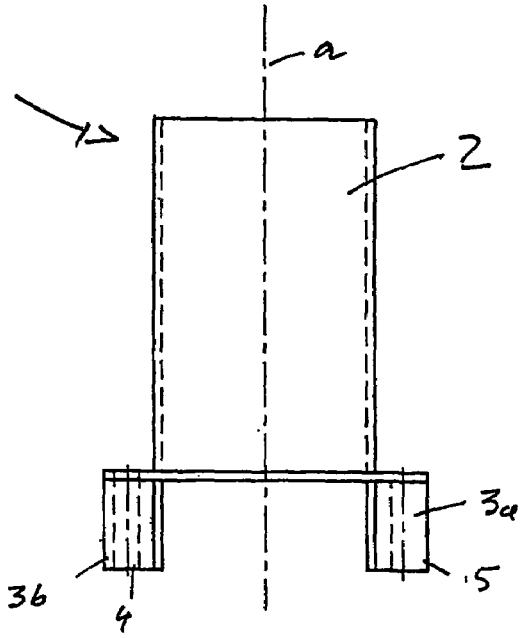
FIG. 3 shows a side view in the direction of the arrow II of FIG. 1.
Figure 4:
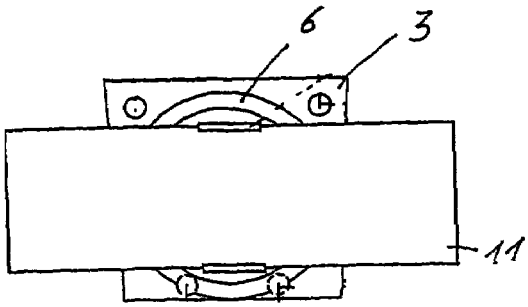
FIG. 4 shows a plan view of a coil former according to FIGS. 1 to 3, wound and provided with a core
Figure 5:
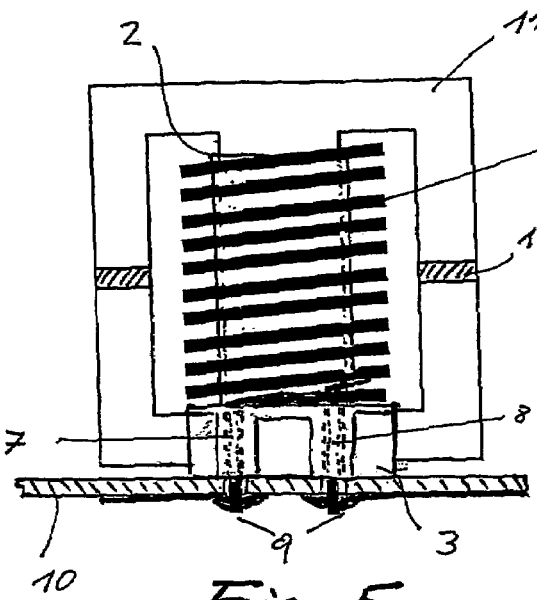
FIG. 5 shows the former-coil-core arrangement as in FIG. 4 but in side view, soldered onto a printed circuit board.
Figure 6:
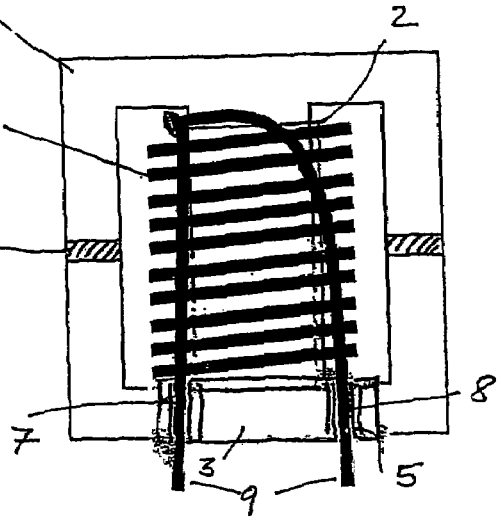
FIG. 6 shows a view as in FIG. 5, but seen from the opposite side.

FIGS. 4 to 6 show the wound coil former according to FIGS. 1 to 3. In this case a winding or coil 6 is formed from two parallel wound wires 7, 8 e.g. made of enameled copper wire. For fabrication of the coil 6, the wires 7,8 with their beginnings are inserted through the drilled holes 4 (FIG. 5), the coil 6 is wound onto the winding form 2 and then the ends of the wires 7,8 are guided downward and placed in the grooves 5. The downward protruding ends of the wires 7,8 are shortened until they protrude a few millimeters above the drilled holes 4 or grooves 5, thereby forming solder pins 9. Using said solder pins 9, the wound component can be mounted on a printed circuit board 10 and soldered, as indicated in FIG. 5.

It can therefore be seen that with the invention the otherwise customary separate leads for the solder pins are formed by the winding wire of the coil and merge directly into the solder pins as one piece.

In the embodiment according to FIGS. 4 to 6, the coil 6 is completed by an E-core 11 consisting of two halves, plastic spacers 12 glued into the air gap also mechanically fixing the two core halves. The winding of the coil 6 can if required also be fixed using adhesive, e.g. an artificial resin. The asymmetrical arrangement of the solder pins 9 ensures correct mounting of the entire wound component on a printed circuit board 10.

Figure 7:
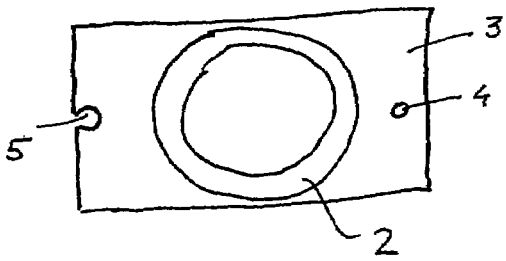
FIG. 7 shows a plan view of another possible embodiment of a coil former falling within the scope of the invention.

In the exemplary embodiment shown, the coil 6 is a single winding which is, however, dual-wound in order to allow a high current density with reduced spin effect and moderate wire diameter. All variants of coils or windings are possible within the scope of the invention. In the case of an individual, single-wound coil, two terminals or solder pins will naturally also suffice. A coil former suitable for this purpose is shown e.g. in FIG. 7, only one groove 5 and one drilled hole 4 being provided as wire guides in the base 3.

Figure 8:
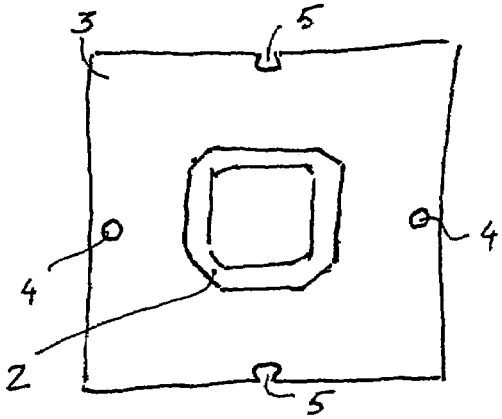
FIG. 8 shows another embodiment of a coil former in a plan view, similar to FIG. 7.

Of course the term "coil" should here likewise also include tapped windings, such as a plurality of windings of a transformer or transducer. In these cases also, three or more solder pins will be required. FIG. 8 shows an embodiment in which the winding form 2 possesses an approximately square cross section, two grooves 5 and two drilled holes 4 being implemented as wire guides in the base 3.

The invention claimed is:

1. A coil former, comprising:

a coil for printed circuit board mounting;

a prismatic or cylindrical winding form for at least one coil;

a base projecting out over said winding form at least in sections; and leads for the one or more coils being formed by the latters' winding wire and implemented with their ends as solder pins which are accommodated and retained in wire guides implemented as outwardly open grooves in the base, wherein the grooves are narrowed towards the outside, the coil wire snapping into place and the solder pins are asymmetrically arranged.

2. The coil according to claim 1, wherein in one section of the base at least one wire guide is implemented as a drilled hole and in an opposite section at least one wire guide is implemented as an open groove.

3. The coil former according to claim 1, wherein the coil wire has a diameter of 1 to 4 mm.

4. The coil former according to claim 2, wherein the coil wire has a diameter of 1 to 4 mm.

5. The coil former according to claim 1, wherein the coil wire is a copper wire.

6. The coil former according to claim 2, wherein the coil wire is a copper wire.

7. The coil former according to claim 3, wherein the coil wire is a copper wire.

8. A coil former with coil for printed circuit board mounting, comprising:

a prismatic or cylindrical winding form for at least one coil;

a base projecting out over said winding form at least in sections; and leads for the at least one coil being formed by the winding wire of the coil, wherein the leads are implemented with their ends as solder pins which are accommodated and retained in wire guides implemented as outwardly open grooves in the base, wherein the grooves are narrowed towards the outside, the coil wire snapping into place by insertion, and wherein the solder pins are asymmetrically arranged for correct mounting.

9. The coil former according to claim 8, wherein the base is a foot part.

10. The coil former according claim 1, the winding form is shaped to carry an E-core.

11. The coil former according claim 8, the winding form is shaped to carry an E-core.

12. The coil former according claim 1, the grooves have a smaller diameter towards the outside and a broader diameter towards the inside.

13. The coil former according claim 8, the grooves have a smaller diameter towards the outside and a broader diameter towards the inside.

* * * * *